US006209862B1

(12) United States Patent
Kelley

(10) Patent No.: US 6,209,862 B1
(45) Date of Patent: Apr. 3, 2001

(54) PRINT MEDIA PICK AND FEED ANTI-WRAP METHOD AND APPARATUS

(75) Inventor: Richard A Kelley, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/577,235

(22) Filed: May 23, 2000

(51) Int. Cl.[7] ..... B65H 3/00
(52) U.S. Cl. ..... 271/18; 271/117; 271/118
(58) Field of Search ..... 271/18, 18.2, 42, 271/107, 117, 118, 109

(56) References Cited

U.S. PATENT DOCUMENTS

| | | | | |
|---|---|---|---|---|
| 5,276,469 | | 1/1994 | Beaufort et al. | 346/153.1 |
| 5,300,160 | | 4/1994 | Wilson et al. | 156/64 |
| 5,507,478 | | 4/1996 | Nottingham et al. | 271/10.02 |
| 5,516,011 | | 5/1996 | Fielding | 222/281 |
| 5,622,364 | * | 4/1997 | Dutton et al. | 271/117 |
| 5,876,133 | | 3/1999 | Klein et al. | 400/625 |
| 5,932,313 | * | 8/1999 | Barton | 271/117 X |

* cited by examiner

*Primary Examiner*—David H Bollinger

(57) ABSTRACT

A method and apparatus for preventing wrap-back of print media into a supply during a pick cycle provides a closed egress path regardless of orientation of a pick mechanism to the paper supply. In an exemplary embodiment, a biased, flexible member is mounted between a fixed position and a moving pick device such that the flexible member follows the pick device as the stack of print media depletes.

14 Claims, 2 Drawing Sheets

PRINT MEDIA PICK AND FEED ANTI-WRAP METHOD AND APPARATUS

BACKGROUND OF THE INVENTION

1. Field of the Invention

The present invention relates generally to print media feeding for hard copy printing and plotting apparatus and, more particularly, to a cut-sheet, print medium, pick and feed mechanisms.

2. Description of Related Art

Many office products such as computer printers and plotters, plain paper facsimile machines, and photocopiers use mechanisms that pick a sheet of paper from a stack of media in an input tray and feed a single sheet of pre-cut printing medium (for example, a sheet of paper of a particular size such as standard letter size, legal size, or A4 (metric), or transparencies, or envelopes) into the hard copy producing apparatus. These mechanisms are generically referred to as "sheet feeders."

Sheet feeders usually are provided with an adjustable or replaceable media cartridge, tray, or other type of stacker in which a user can stack multiple cut-sheets of the media of choice. The use of media cartridges (essentially easily substituted paper trays) adapted to the various styles of media provide a mechanism for quick changes between any particular printing medium by the user. Upon receiving a media feed command ("FEED") from the hard copy machine controller electronics, a sheet picking device is actuated to deliver the top sheet from the stack into the hard copy machine. Under proper operating conditions, a sheet picking mechanism associated with the stacker should deliver a single sheet of the print medium to the hard copy machine input mechanism, such as a set of pinch rollers used for registration and feed into the actual printing subsystem of the machine.

Misfeeds, multiple sheet feeds, paper jams, and the like are common problems associated with sheet feeders. FIGS. 1 and 1A depict a typical problem of a misfeed caused by a premature bending ("wrap" or "wrap-back") of a picked sheet before its leading edge can be captured by an input mechanism (not shown; generally located close to the exit plane of the leading edge of a picked sheet) used to transport the sheet to a printing station. FIG. 1 shows a normal feed of a sheet 100 from a stack 101 of sheets in an input bin 102 by a pick mechanism 103 having a feed arm 104 and a motorized pick roller 105. In FIG. 1 the sheet 100 is being properly fed up the input tray angled wall 106. The details of a stack loader located below a hard copy apparatus' printing mechanisms are shown in U.S. Pat. No. 5,507,478 by Nottingham et al. for PRINTING MEDIA STATUS SENSING, assigned to the common assignee herein and incorporated herein by reference.

FIG. 1A shows a misfeed in which the picked sheet 100 has wrapped around the pick mechanism 103 before properly exiting the bin and being received by the input feed mechanism. High humidity tends to exacerbate such a problem. Thin media or media that has any inherent curl in it is highly susceptible to the problem.

One solution to the problem is to flatten out the feed angle. U. S. Pat. No. 5,876,133 by Kleln et al. for a SHEET PRESENTER AND METHOD OF USING SAME has an elongated platform adapted to engage a printer. A pair of spaced walls extend upwardly from the platform to support pivotally an arm at one end thereof. A motor disposed at another end of the arm is operatively connected to a drive roller wherein the mass of the motor urges the corresponding end of the arm downwardly to engage a sheet. This however requires a much larger workspace footprint than a printer having a contained input tray located below the printing zone such as illustrated by FIGS. 1 and 1A and preferable in the marketplace.

Another solution is to provide a paper guide fixed to a pivotal feed arm 104. However, such paper guides move with the arm. When the rollers of the feed arm are on a full stack, the paper guides protrude above the highest level of the feed arm, requiring extra height in the media bin to accommodate them. If the guides are made to be very short to minimize the amount that they protrude above the feed arm's highest position, they will not be effective when the paper stack is low and the feed arm pivoted into a more vertical than horizontal orientation. The picked sheet of a low stack will tend even more to wrap around the feed arm before reaching the top of the wall 106 where it can be captured by transport rollers.

Therefore, there is a need to facilitate the transfer of a sheet of print media from an internal input supply stack to a hard copy machine's printing zone.

SUMMARY OF THE INVENTION

In its basic aspects, the present invention provides guide device for a cut-sheet print media stack bin having a sheet egress guide wall associated with a pick mechanism, including: fixedly mounted substantially parallel to sheets stacked in said bin, a member having a reach such that a guiding end is substantially proximate an exit extremity of the guide wall; and a biased flexible guide attached to said member at a position distal of said guiding end, wrapped about said reach, and attached to said pick mechanism wherein moving said pick mechanism extends and retracts said flexible guide such that said flexible guide between said reach and said pick mechanism provides an anti-wrap barrier to the sheets during egress from said bin.

In another basic aspect, the present invention provides a method for preventing wrap of a picked cut-sheet of paper about a stack-following pick mechanism in an input bin, including the steps of: mounting a flexible member in fixed relationship to said bin and coupled to said pick mechanism; and moving a surface of the flexible member in coordination with said pick mechanism to form a closed exit path from said bin.

In another basic aspect, the present invention provides a print media anti-wrap device including: coupled to a pick device in a paper supply, a mechanism for maintaining a closed print media egress path configuration such that a leading edge of exiting paper is guided out of the supply and prevented from wrapping back onto the pick device.

Some of the advantages of the present invention are:

it provides a mechanism for preventing wrapping of a picked sheet of print media in an input bin; and it does not increase the height of the input bin.

The foregoing summary and list of advantages is not intended by the inventor to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically annotated.

DESCRIPTION OF THE PREFERRED EMBODIMENT

Reference is made now in detail to a specific embodiment of the present invention, which illustrates the best mode presently contemplated by the inventor for practicing the invention. Alternative embodiments are also briefly described as applicable. The term "paper" is used hereinafter to be synonymous with all forms of print media; no limitation on the scope of the invention is intended nor should any be implied.

Figure 1:
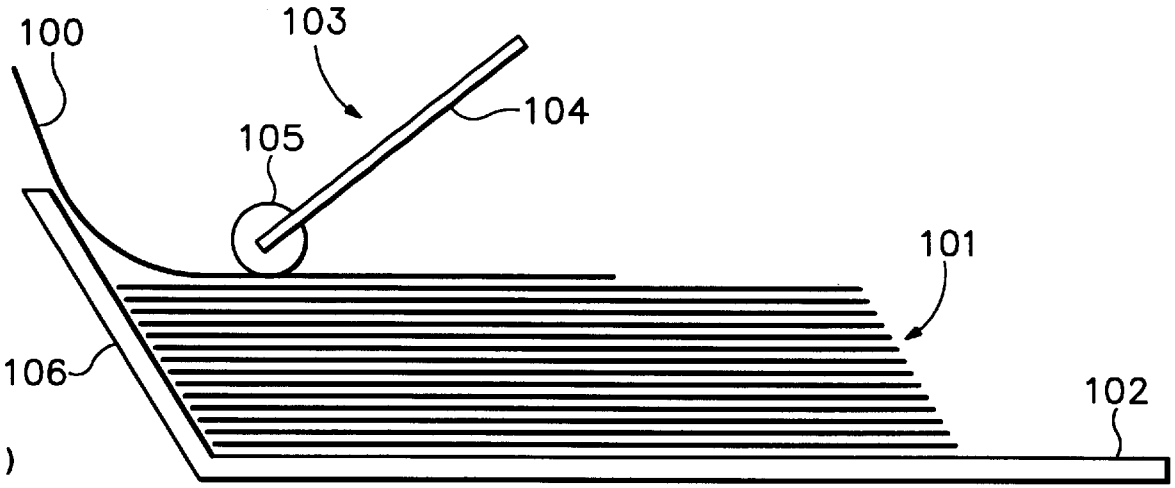
FIG.1 (PRIOR ART)
FIG. 1 (Prior Art) is a schematic illustration of a known manner print media bin and pick mechanism showing a normal sheet pick.
Figure 1A:
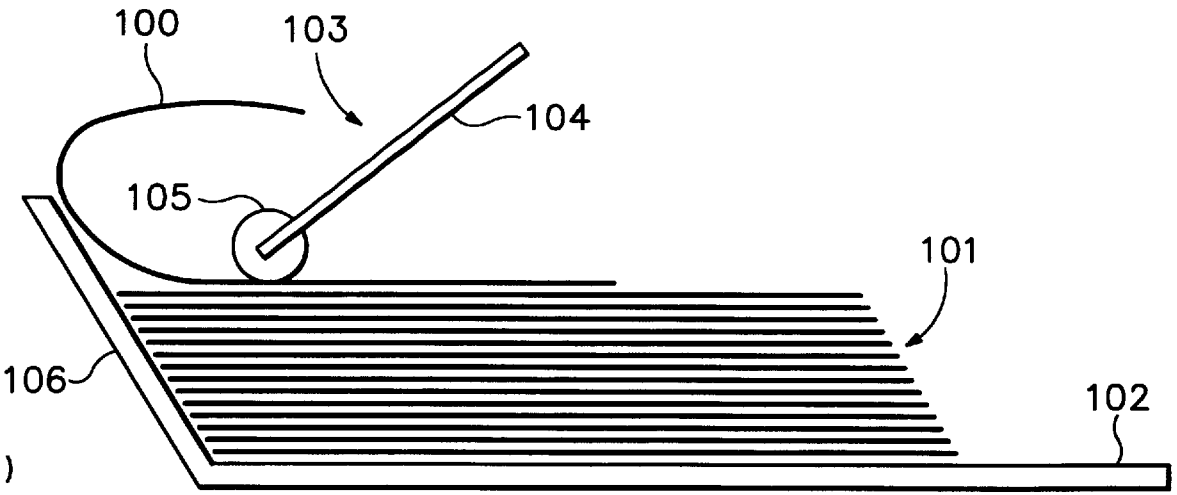
FIG.1a (PRIOR ART)
FIG. 1A (Prior Art) is a schematic illustration of a known manner print media bin and pick mechanism as in FIG. 1 but showing a wrap problem.
Figure 2:
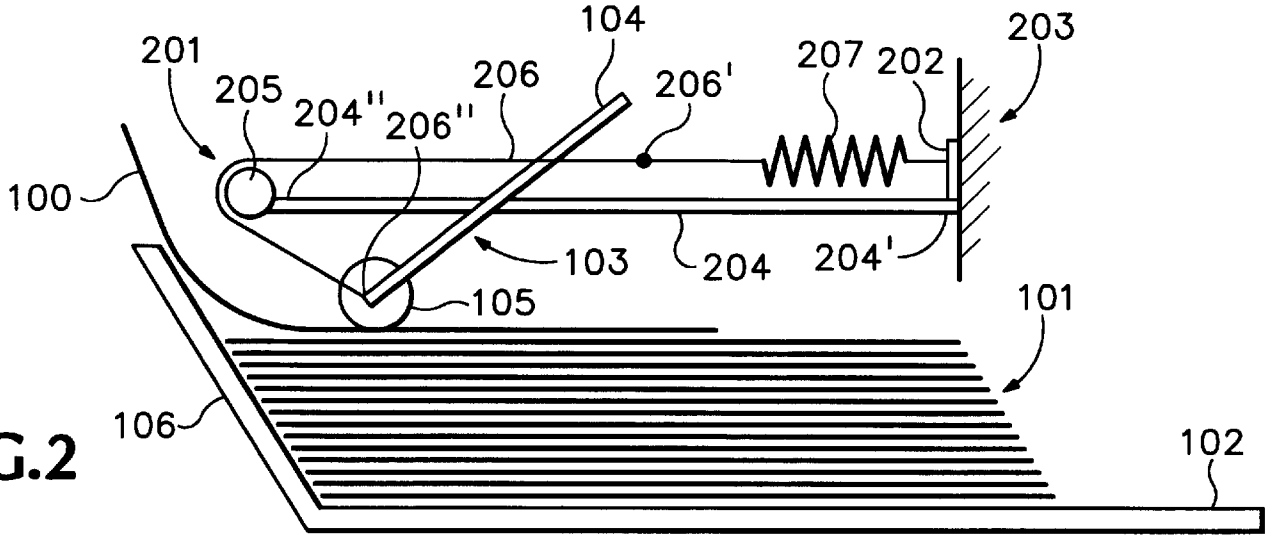
FIG. 2 is a first embodiment of the present invention.

FIG. 2 depicts in schematic form a first embodiment of the present invention. At least one paper guide 201 device is fixedly mounted by a stanchion 202 member to a chassis 203 of the hard copy apparatus or to a fixed frame member of the input bin 102. An arm 204 member extends from one end 204' attached to the stanchion 202 in a substantially parallel orientation to the stack 101. The arm 204 has a second end 204" reach which is proximate the upper reach of the angled wall 106 of the bin 102. Mounted at the second end 204" of the arm 204 is an idler roller 205. In a low cost alternative, the idler roller 205 can be replace with a convex radius, smooth, surface member at the second end 204" of the arm 204. A flexible paper guide 206 is connected at a first end 206' to the stanchion 202 by a substantially linear force biasing mechanism 207, such as a spring. The flexible paper guide 206 in a preferred embodiment is a Mylar™ (a brand name for polyester film compounds) sheet because of its combined flexibility, strength, and low coefficient of friction. Other exemplary materials which may be employed are thin, flexible plastic, cloth, string or wire. A second end 206" of the flexible paper guide 206 is affixed to the feed arm 104 at the pick roller 105 or to the pick roller axle. It will be recognized by those skilled in the art that this cantilevered arm 204 is one implementation and that any surface or mechanism that will support the roller-wrap point-205 for the flexible guide 206 may be employed.

In operation, as the stack 101 of cut-sheet media is depleted, the pick mechanism 103 pivots and the pick roller 105 moves downwardly, away from the angled wall 106 and toward the center of the stack 101. As it pivots, the pick mechanism 103 pull the flexible paper guide 206 against the bias 207 around the idler roller 205. A picked sheet 100 is always guided between the angled wall 106 and the descending surface of the flexible paper guide 206. Thus, acting together, the wall 106 and the surface of the flexible paper guide 206 form a substantially closed, relatively narrow, exit path for the picked sheet 100. Any tendency of the sheet 100 of picked media to wrap is deflected back toward the angled wall 106 and toward the hard copy apparatus input paper transport mechanisms (not shown).

Figure 3:
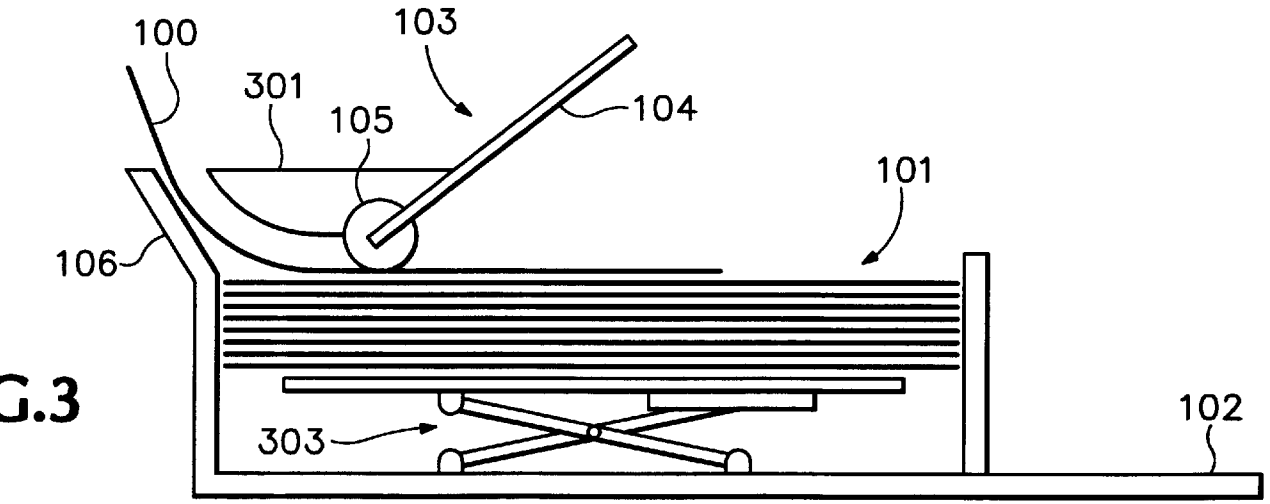
FIG. 3 is an alternative embodiment of the present invention.

FIG. 3 is an alternative embodiment of an anti-wrap mechanism for a print media input bin. A small, solid, wrap deflector 301 is affixed to the feed arm 104. A known manner mechanical or electromechanical, stack lift 303 is provided in the bin 102 below the stack 101. If at all, the feed arm 104 swings only through a very small angle. The deflector 301 can be attached to the arm 104 adjacently to a modified, short angled wall 106' of the bin 102. Since the arm 104 is substantially in a fixed orientation, the deflector 301 can be small and does not increase the overall height of the bin 102.

Thus, in accordance with the present invention there is a method and apparatus for preventing wrap-back of print media into a supply during a pick cycle provides a closed egress path regardless of orientation of a pick mechanism to the paper supply. In an exemplary embodiment, a biased, flexible member is mounted between a fixed position and a moving pick device such that the flexible member follows the pick device as the stack of print media depletes.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, the anti-wrap method and apparatus taught herein may be used in conjunction with rolled or fan-fold form of print media. While the primary paper path guide is shown as an angled wall of the bin itself, separate paper path guides are also known in the art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for. . .."

What is claimed is:

1. A guide device for a cut-sheet print media stack bin having a sheet egress guide wall associated with a pick mechanism, comprising:

fixedly mounted substantially parallel to sheets stacked in said bin, a member having a reach such that a guiding end is substantially proximate an exit extremity of the guide wall; and a biased flexible guide attached to said member at a position distal of said guiding end, wrapped about said reach, and attached to said pick mechanism wherein moving said pick mechanism extends and retracts said flexible guide such that said flexible guide between said reach and said pick mechanism provides an anti-wrap barrier to the sheets during egress from said bin.

2. A device as set forth in claim 1, comprising:

said flexible guide includes a flexible sheet fabricated of a material selected from a group including polyester film, plastic, cloth, string and wire.

3. A device as set forth in claim 1, comprising:

said reach has a geometric surface configured to allow the flexible sheet to slide thereon without binding.

4. A device as set forth in claim 1, comprising:

said reach has an idler roller mounted thereon for receiving one surface of said flexible sheet around a radial surface region thereof.

5. A device as set forth in claim 1, comprising:

said flexible guide includes a mount for rigidly attaching said member at an end distal from said reach such that said member is substantially parallel to a stack the cut-sheet print media in the bin, and a spring fixedly attached at a first end to said mount and at a second end to said flexible sheet between said spring and said reach.

6. A method for preventing wrap of a picked cut-sheet of paper about a stack-following pick mechanism in an input bin, comprising the steps of:

mounting a flexible member in fixed relationship to said bin and coupled to said pick mechanism; and moving a surface of the flexible member in coordination with said pick mechanism to form a closed exit path from said bin.

7. The method as set forth in claim 6, the step of moving comprising:

biasing the flexible member fixed relationship to the bin for extending and retracting the flexible member, wrapping the flexible member about a reach proximate an egress of the bin, and pulling the flexible member about the reach by moving the pick mechanism.

8. A print media anti-wrap device comprising:

coupled to a pick device in a paper supply, a mechanism for maintaining a closed print media egress path configuration such that a leading edge of exiting paper is guided out of the supply and prevented from wrapping back onto the pick device.

9. The device as set forth in claim 8, comprising:

in a paper supply having a supply lift, a deflector attached to the pick device, the deflector having surface region forming a guide wall between the pick mechanism and a primary paper path guide mechanism.

10. The device as set forth in claim 8, comprising:

in a paper supply having a stack of cut-sheet paper and having a pivoting pick mechanism for following depletion of the stack, said mechanism for maintaining a closed print media egress path includes, fixedly mounted substantially parallel to sheets stacked in said bin, a member having a reach such that a guiding end is substantially proximate an exit extremity of the guide wall; and a biased flexible guide attached to said member at a position distal of said guiding end, wrapped about said reach, and attached to said pick mechanism wherein moving said pick mechanism extends and retracts said flexible guide such that said flexible guide between said reach and said pick mechanism provides an anti-wrap barrier to the sheets during egress from said bin.

11. A device as set forth in claim 10, comprising:

said flexible guide includes a flexible sheet fabricated of a material selected from a group including polyester film, plastic, textiles, string and wire.

12. A device as set forth in claim 11, comprising:

said reach has a geometric surface configured to allow the flexible sheet to slide thereon without binding.

13. A device as set forth in claim 11, comprising:

said reach has an idler roller mounted thereon for receiving one surface of said flexible sheet around a radial surface region thereof.

14. A device as set forth in claim 10, comprising:

said flexible guide includes a mount for rigidly attaching said member at an end distal from said reach such that said is substantially parallel to a stack of the cut-sheet print media in the bin, and a spring fixedly attached at a first end to said mount and at a second end to said flexible sheet between said spring and said reach.

* * * * *